United States Patent [19]

Ferris et al.

[11] Patent Number: 4,498,674

[45] Date of Patent: Feb. 12, 1985

[54] BOARD GAME WITH A COMMON PIECE HAVING A SPINNER

[75] Inventors: Michael J. Ferris; Paul H. Wise, both of Chicago; Jeffrey D. Breslow, Highland Park, all of Ill.

[73] Assignee: Marvin Glass & Associates, Chicago, Ill.

[21] Appl. No.: 463,920

[22] Filed: Feb. 4, 1983

[51] Int. Cl.[3] ..... A63F 3/00

[52] U.S. Cl. ..... 273/243; 273/289; 273/142 R; 273/291

[58] Field of Search ..... 273/243, 289, 142 R, 273/142 A

[56] References Cited

U.S. PATENT DOCUMENTS

| | | | |
|---|---|---|---|
| 1,517,847 | 12/1924 | Llera et al. | 273/249 |
| 1,762,269 | 6/1930 | Harris | 273/254 X |
| 2,722,424 | 11/1955 | Hum | 273/291 X |
| 3,406,974 | 10/1968 | Nelson | 273/289 X |
| 4,128,246 | 12/1978 | Hicks et al. | 273/243 |
| 4,192,512 | 3/1980 | Erickson et al. | 273/243 |
| 4,225,138 | 9/1980 | Wolf | 273/243 |

FOREIGN PATENT DOCUMENTS

| | | | |
|---|---|---|---|
| 77034 | 11/1948 | Czechoslovakia | 273/142 R |

*Primary Examiner*—Richard C. Pinkham
*Assistant Examiner*—Scott Brown
*Attorney, Agent, or Firm*—John S. Pacocha

[57] ABSTRACT

A board game for two to four players in which each player is assigned an individual, flippable, playing piece that is used to chase an exchangable general playing piece which is able to earn points. The players move their pieces on a board having a number of paths of spaced indicia with reversible and collectable markers positioned atop the indicia. Initially one of the players is determined to be the one using the exchangable playing piece. The exchangable piece carries a spinner for determining its advancability. The other players, using another spinner, chase and try to catch the exchangable piece with the aggressive character of their assigned pieces facing upwardly. When an encounter between the general piece and one of the assigned pieces occurs, the outcome is determined by which side of the assigned piece faces upwardly. The character of the assigned pieces may be changed either by the spinner or by returning to the starting position.

18 Claims, 4 Drawing Figures

BOARD GAME WITH A COMMON PIECE HAVING A SPINNER

BACKGROUND OF THE INVENTION

1. Field of the Invention

This invention relates generally to board games and more particularly to board games that embody a theme suggested by other media or events.

2. Background Art

Board games, particularly those based on various themes suggested by real life events or occurrences, or by other games, have long been popular. For example, prior art patents assigned to the assignee of the present invention disclose board games embodying the themes of: a beauty contest, U.S. Pat. No. 3,861,686; investment, U.S. Pat. No. 3,865,379; invention, U.S. Pat. No. 3,885,792; golf, U.S. Pat. No. 3,989,249; magic acts, U.S. Pat. No. 3,989,251; fast food frachises, U.S. Pat. No. 3,994,499; and the legendary creature "BIG FOOT", U.S. Pat. No. 4,128,246. Recently, video games, both the types playable in arcades and by means of adapters on home television sets, have become popular pastimes. Such video games have also provided themes for board games. There are currently board games based on the Bally/Midway "PAC-MAN", Nintendo "DONKEY KONG" and Sega "FROGGER" video games which are disclosed respectively in copending application Ser. Nos. 339,850 filed Jan. 18, 1982; 424,354 filed Sept. 27, 1982; and 426,368 filed Sept. 29, 1982, all of which are assigned to the assignee of the present invention. There remains, however, a need for additional portable board games that provide entertaining, challenging and competitive play of a game employing a theme suggested by popular video games.

SUMMARY OF THE INVENTION

The present invention is concerned with providing a board game based on the theme of the Bally/Midway "MS. PAC-MAN" video game which affords entertaining and challenging play including providing for changing player characters and roles during play of the game as well as providing a combined playing piece chance device. These and other objects and advantages of the invention are achieved by providing a game board having a substantially horizontal playing surface with spaced indicia defining a plurality of paths, some of which are separated by barrier indicia, passageway indicia between paths separated by barrier indicia, and designated starting positions for the players. Individual player pieces of changable character are initially positioned at designated starting positions for movement along the paths defined by the spaced indicia. An exchangable general playing piece carries a spinner for determining the advancability of that piece. A second chance device determines the movability and affects the character of the individual playing pieces. The players move the individual pieces to chase the general playing piece in order to exchange roles with the general playing piece and then be able to move the general playing piece along the spaced indicia to score points. Each of the individual playing pieces represents one of the ghost monsters, "INKY", "BLINKY", "PINKY", and "SUE" in the "MS. PAC-MAN" video game and the general playing piece simulates "MS. PAC-MAN" with the spaced indicia simulating the dots "munched" by "MS. PAC-MAN" upon proceeding through the maze of paths.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
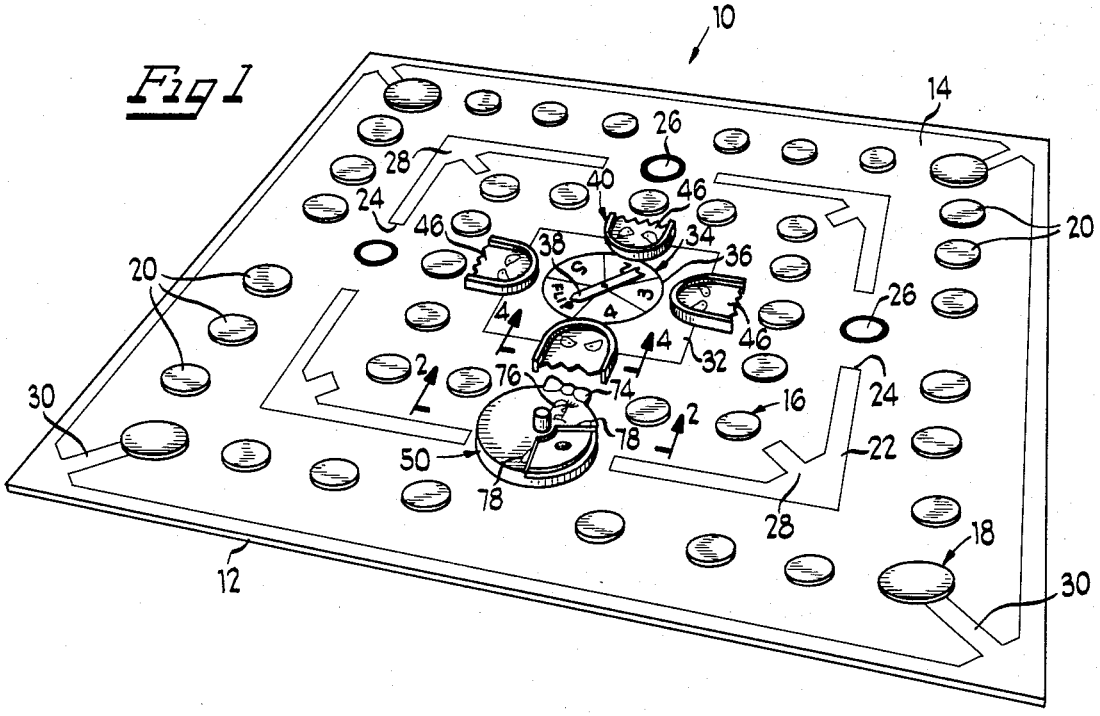
FIG. 1 is a perspective view of an embodiment of the present invention showing a game set up for play.
Figure 2:
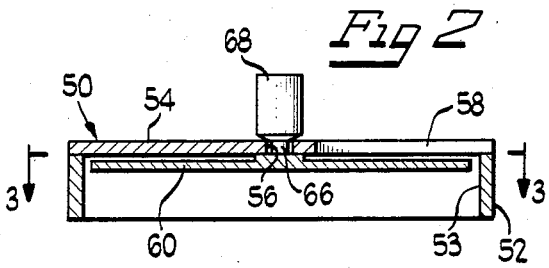
FIG. 2 is an enlarged sectional view of the general playing piece taken substantially along line 2—2 of FIG. 1.
Figure 4:
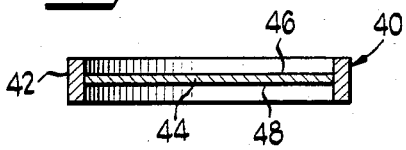
FIG. 4 is an enlarged sectional view of an individual playing piece taken substantially along line 4—4 of FIG. 1.
Figure 3:
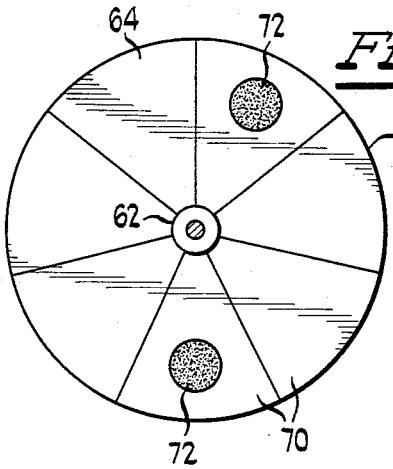
FIG. 3 is a sectional view taken substantially along line 3—3 of FIG. 2.

Referring now to the drawings in which like parts are designated by like reference numerals throughout the several views, there is shown in FIG. 1 a board game 10 having a game board 12 with a substantially planar playing surface 14. Concentric square paths 16 and 18 are each formed by spaced indicia such as circles or dots (not seen in the drawings) upon which removable discs 20 or other markers are positioned. Opposed sides of the discs 20 have different colors or other means to readily distinguish the sides. Inner path 16 is separated from outer path 18 along most of the length of both paths by barrier indicia 22. Four spaced opening passageways 24 are provided in the barrier 22. In each of the four openings a circular indicia 26 is provided. Each indicia 26 is distinguishable from the other by color or other means such as numbering the indicia. At each corner of the inner path 16 there is a diagonally disposed tunnel passageway 28 and a similar diagonal tunnel passageway 30 is included at each corner of the outer path 18. A center square 32 includes a chance spinner 34 which has a circle 36 divided into five substantially equal sectors designated "2", "3", "4", "5" and "FLIP" and a pointer 38 mounted for rotation about the center of the circle.

Four individual, flippable, playing pieces 40 each have a horseshoe or U-shaped plastic rim 42 with a central web 44. Each of the pieces 40 is identical in structure but is distinguished by the decoration or more particularly the color on the opposed sides 46 and 48 of the central web 44. The U-shaped rim 42 and the web 44 may be formed as an integrally molded plastic piece with the decorations applied to the sides 46 and 48 by painting, decals or other conventional methods. In this embodiment, the decorations simulate the four ghost monsters "INKY", "BLINKY", "PINKY" and "SUE" in the "MS. PAC-MAN" video game. In addition, the opposed sides 46 and 48 of each piece are distinguished by color from each other with all of the sides 48 being pale as compared to the sides 46. Thus, the playing pieces 40 each have two different or distinguishable sides identifying two different characters and each piece is also distinguishable from the other three. The size of each of the playing pieces 40 is such that each piece may be positioned over one of the markers 20 with the marker fitting between the inside walls of the U-shaped rim 42 and the downwardly facing side of the web 44.

An exchangable general playing piece 50 has a cylindrical casing 52 with an opening 53 at the bottom. The substantially planar top wall 54 includes a central aperture 56 and a sector opening 58 of approximately 100 degrees. Spinner disc 60 having a diameter less than the inside diameter of the casing 52 includes a central raised bearing boss 62 on its upwardly facing side 64. A mounting stem 66 extends upwardly from the boss 62 through the aperture 56 and has a knob 68 secured to the stem 66 by a press fit or a suitable adhesive. Thus, the spinner disc 60 is mounted for rotation in a substantially horizontal plane within the cylindrical casing 52 of the general playing piece 50. The upwardly facing side 64 of the spinner disc 60 is divided into seven segments 70 of approximately 51½ degrees each with two of the segments bearing indicia 72 in the form of black circular dots which distinguish the two segments from the other segments 70. The segment bearing the indicia 72 are spaced from each other by two of the other segments on one side and three of the other segments on the other side. Of course, the size of the sector opening 58 as well as the number of segments 70 and the relative proportions of each type of segment may be varied depending on the odds used in the game. In addition to accommodating the spinner disc 60, the inner diameter of the cylindrical casing 52 and the height of the space from the bottom of the spinner disc 50 to the playing surface 14 are sufficiently large to enable the general playing piece to be positioned atop the markers 20 as well as the individual playing pieces 40. General playing piece 50 bears decorative elements such as the bow 74, eyes 76, and lips 78 simulating the "MS. PAC-MAN" character of the video arcade game of the same name.

Play of the game 10 for four players begins with the game board 12 set up substantially as shown in FIG. 1 although the positioning of the exchangable general playing piece 50 on the indicia 26 may change depending on which player is initially determined to be using the "MS. PAC-MAN" general playing piece. All of the individual playing pieces 40 are initially placed on the board 12 on their respective assigned starting positions as shown in FIG. 1 with the darker colored side 46 facing upwardly indicating the aggressive monsters. Each player is assigned or allocated an individual playing piece 40. Should the game be played by less than four players, any unallocated playing pieces 40 are removed from the board. The center spinner 34 may be used to determine which player initiates the game as "MS. PAC-MAN" with the player obtaining the highest number getting that honor and advantage. General playing piece 50 is positioned at the start of the game on the indicia 26 nearest the player's assigned individual ghost/monster playing piece 40. The player using the exchangable piece 50 will try and earn points by collecting or "munching" the markers 20 as well as by gobbling vulnerable ghosts 48 while the other players will chase the "MS. PAC-MAN" piece 50 and try to be the first to catch the exchangable piece with a monster 46. Both the exchangable piece 50 and the assigned pieces 40 may be moved from marker to marker, or onto the underlying indicia if a marker 20 is removed from the board.

The player using the exchangable general playing piece 50 does not utilize the assigned individual playing piece 40 which remains in the start position during the player's use of the exchangable general piece. Playing piece 50 is advanced from marker to marker, or onto the underlying indicia, whenever the spinner disc 60 does not show a complete circular indicia 72. The player that is "MS. PAC-MAN" spins the disc 60 by grasping the knob 68 between thumb and forefinger and twisting the knob. As long as a complete circular indicia 72 does not appear within the segment opening 58, the player is permitted to advance the piece 50 to an adjacent marker indicia. Variations in the play may be introduced by limiting the direction of movement of the general playing piece 50 or awarding a premium for moving within a particular section of the board as well as by changing the spinner 60 odds. Thus, for example, if a player were not permitted to advance the piece 50 whenever any portion of the indicia 72 appeared, or even whenever any portion of the segment bearing the indicia 72 appeared in the sector opening 58, the movement of the piece 50 would be reduced.

When the piece 50 is advanced atop a marker disc 20, the disc is turned over to expose the opposite side. The player having the "MS. PAC-MAN" role may continue to spin and move the piece 50 as long as the indicia 72 does not appear. Should the player decide to surrender the "MS. PAC-MAN" role before the indicia 72 appears in the sector opening 58, the player will be entitled to collect all of the markers 20 that have been landed upon and turned over during that turn. The "MS. PAC-MAN" role and the exchangable piece 50 are then passed to another player such as the adjacent clockwise player. However, if spinner disc 60 stops showing one of the turn-stopping indicia 72, then all of the markers 20 landed upon during that turn are turned back over to their original facing side and the player does not collect any of the markers. Once a marker is removed from the board, the mixer is not replaced on the board.

If during the course of moving the general piece 50 the player encounters one of the individual playing pieces 40, the outcome is determined by the then indicated character of that assigned playing piece 40. When the aggressive or monster character of the playing piece 40 is indicated by the darker color of the side 46 used in the starting position, the monster 46 wins the encounter and the player to whom that piece belongs then exchanges roles and becomes "MS. PAC-MAN". The new player's assigned playing piece is then returned to the assigned starting position for the duration of that player's use of the exchangable general playing piece 50 with the new "MS. PAC-MAN" player proceeding in a chosen direction from the point of the encounter. However if the non-aggressive "ghost" character of the individual playing pieces is indicated by the lighter colored side 48 facing upwardly at the time of the encounter, then the "MS. PAC-MAN" character wins the encounter for which a point award is made. The individual playing piece 40 is then returned to the assigned starting position and turned over with the aggressive monster side 46 facing upwardly.

Of course, the player using the general piece 50 will normally seek to avoid encounters with individual playing pieces having their monster side 46 facing upwardly. However, the other players using the assigned pieces 40 will chase and try to catch the "MS. PAC-MAN" piece 50 in order to exchange roles and then be able to collect markers to obtain points. The players using the pieces 40 operate the spinner 34 at the beginning of a turn and move the indicated number of spaces to try and catch the "MS. PAC-MAN" piece 50. However, if the spinner pointer 38 stops on the "FLIP" segment, the player's piece 40 is turned over exposing the lighter colored side 48 and changing the aggressive monster character to one that is vulnerable in an encounter with the "MS. PAC-MAN" piece 50. When a player's piece has the vulnerable side 48 facing upwardly, the player has the option of waiting to spin another "FLIP" on the next turn or may try and return to the assigned starting position where the piece can be flipped over to the aggressive monster side 46.

Generally the players move along either the inner path 16 or the outer path 18 "munching" the markers 20 and passing from path to path through the opening passageways 24. However, near the end of the game when only a few of the markers 20 are left it may be desirable to move more quickly from one path to the other. Accordingly, tunnel passageways 28 and 30 are also provided. Any player may travel from an outer tunnel 30 to an inner tunnel 28 or visa versa, but no player may move from an outer tunnel 30 to another tunnel 30 or from an inner tunnel 28 to another tunnel 28. If a player's piece is on a tunnel, that tunnel is blocked to the other players. By awarding one point for each collected marker 20 and two points for each gobbled ghost 48, a goal of eighteen points has been found to be attainable within an entertaining and reasonable span of time with the embodiment shown and described.

Changes in the paths and scoring as well as other changes and modifications will occur to those skilled in the art. It is intended in the appended claims to cover all such changes and modifications as fall within the true spirit and scope of the present invention.

What is claimed as new and desired to be secured by Letters Patent is:

1. A board game comprising:
a board having a playing surface and containing a plurality of spaced indicia;
a plurality of markers;
each marker being positionable on one of the indicia;
first playing pieces movable on the playing surface and each positionable atop one of the markers;
a second playing piece movable on the playing surface and positionable over the markers;
the second playing piece bearing chance means;
the second playing piece including a generally cylindrical casing;
the casing having a substantially planar top and a wall depending from the top; and
a spinner disc mounted for rotation below the top with only a portion of the disc viewable.

2. The board game of claim 1 in which
the portion of the disc is viewable through an opening in the top.

3. The board game of claim 1 in which:
the generally cylindrical casing has a bottom;
the spinner disc is spaced from the bottom; and
the bottom has an opening to receive one of the markers.

4. The board game of claim 3 in which:
the spinner disc has a bottom;
the bottom of the generally cylindrical casing is positionable on the playing surface of the board; and
the height of the space from the bottom of the spinner disc to the playing surface is sufficiently large to enable the general playing piece to be positioned atop one of the markers.

5. The board game of claim 4 in which the inner diameter of the generally cylindrical casing is sufficiently large to accommodate one of the markers.

6. The board game of claim 1 in which the second playing piece is positionable over the first playing piece.

7. The board game of claim 1 including a second chance means.

8. The board game of claim 1 in which:
each of the playing pieces has opposed sides;
each side indicates a different character of the first playing piece; and
the sides are reversible during play of the game.

9. The board game of claim 8 in which:
one of the opposed sides is upwardly facing and the other side is downwardly facing; and
the upwardly facing side determines the character of the first playing piece during a turn.

10. The board game of claim 9 in which the character of the first playing piece with the one side facing upwardly is that of an aggressor which may attack the second playing piece and the character with the other side facing upwardly is vulnerable to attack by the second playing piece.

11. The board game of claim 8 in which the upwardly facing side may be reversed by a second chance means.

12. The board game of claim 1 in which:
at least one of the first playing piece is assigned to each player; and
the second playing piece is a general piece that is exchangable among players in lieu of the assigned piece.

13. A board game comprising:
an individual playing piece for each player;
a general playing piece that may be used by each player;
first chance means;
second chance means;
a board having a plurality of spaced indicia;
the individual and general playing pieces being movable from indica to indicia;
the general playing piece having a top with a depending wall and bearing the second chance means;
the depending wall having a bottom positionable on the board;
the second chance means including a spinner disc mounted for rotation below the top with only a portion of the disc viewable from the top of the general playing piece.

14. The board game of claim 13 in which:
the board has concentric paths formed by the spaced indicia;
barrier means on the board separate paths; and
passageways indicated on the board permit the playing pieces to move between separated paths.

15. The board game of claim 13 in which the general playing piece is exchangable among the players in lieu of the assigned piece.

16. The board game of claim 15 in which the individual piece is used to attack the general piece and effect the exchange.

17. The board game of claim 13 including a plurality of markers with each marker positionable on one of the indicia.

18. The board game of claim 13 in which:
the bottom of the general playing piece has an opening;
the size of the opening is sufficiently large to receive one of the markers; and
the spinner disc is spaced from the bottom of the generally playing piece a sufficient distance to accommodate the one marker.

* * * * *